US006294868B1

(12) United States Patent
Imura et al.

(10) Patent No.: US 6,294,868 B1
(45) Date of Patent: Sep. 25, 2001

(54) ELECTRON GUN FOR ELECTRON TUBE WITH COLD CATHODE

(75) Inventors: Hironori Imura; Nobuya Seko, both of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/266,775

(22) Filed: Mar. 12, 1999

(30) Foreign Application Priority Data

Mar. 20, 1998 (JP) ..... 10-072341

(51) Int. Cl.[7] ..... H01J 29/46

(52) U.S. Cl. ..... 313/452; 313/309; 313/414; 315/5; 315/5.33

(58) Field of Search ..... 313/309, 306, 313/308, 310, 336, 351, 444, 452, 414, 412; 315/3, 5, 3.5, 5.33, 5.37; 445/6

(56) References Cited

U.S. PATENT DOCUMENTS 5,929,557 * 7/1999 Makishima et al. ..... 313/309

6,024,618 * 2/2000 Makishima et al. ..... 445/6

FOREIGN PATENT DOCUMENTS 0 772 218 5/1997 (EP) .
9-115453 5/1997 (JP) .
9-129144 5/1997 (JP) .

* cited by examiner

*Primary Examiner*—Nimeshkumar D. Patel
*Assistant Examiner*—Karabi Guharay
(74) *Attorney, Agent, or Firm*—Young & Thompson

(57) ABSTRACT

A Wehnelt electrode and a cold cathode are pressed against and fixed to each other under spring force with a ceramic plate interposed therebetween. Metallized layers connected to a gate electrode and a focusing electrode are disposed on surfaces of the ceramic plate. The gate electrode and the focusing electrode are connected to external power supplies via the metallized layers as feeder path structures. With this arrangement, an electron gun for an electron tube with a cold cathode can be designed with increased degree of freedom, reduced in size, can easily be assembled at the time of manufacture, has high dimensional accuracy, provides high dielectric strength between gate and Wehnelt electrodes, and is highly resistant to vibrations.

23 Claims, 8 Drawing Sheets

Fig. 4(a) (Prior Art)
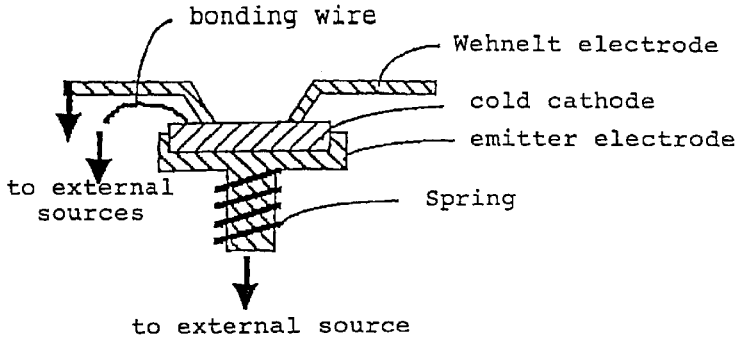
Fig. 4(b) (Prior Art)
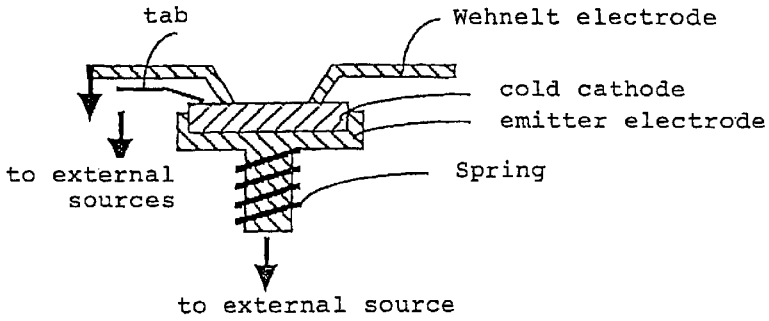
Fig. 4 ( c ) (Prior Art)
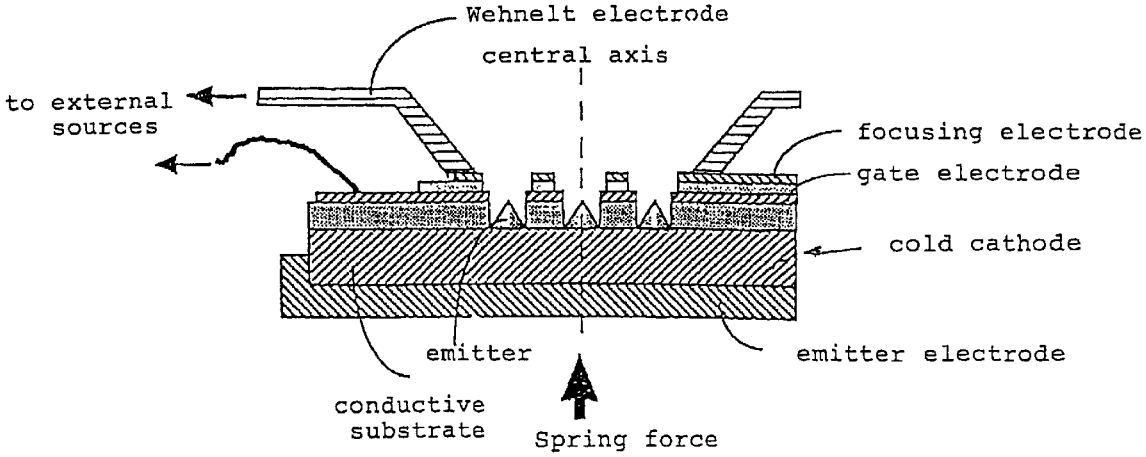

Fig. 6( a )
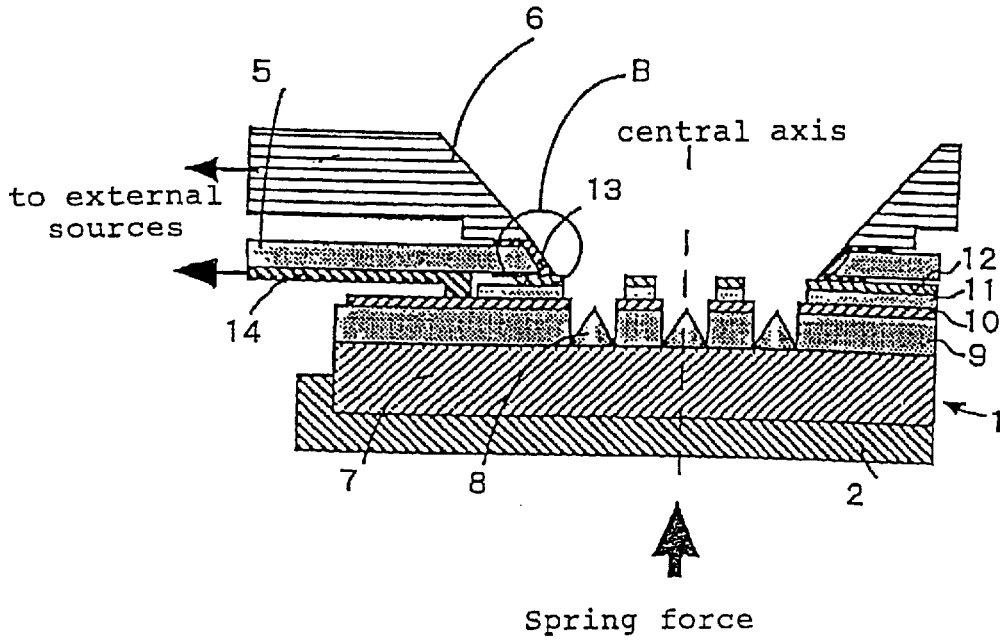
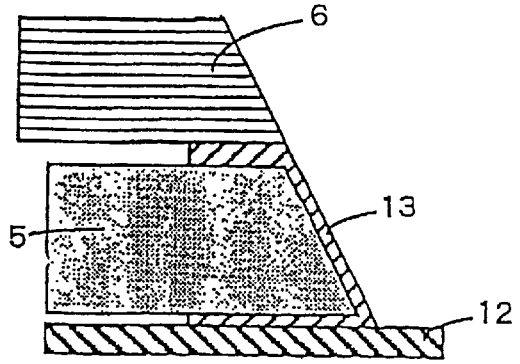
Fig. 6 ( b )

Fig. 7( a )
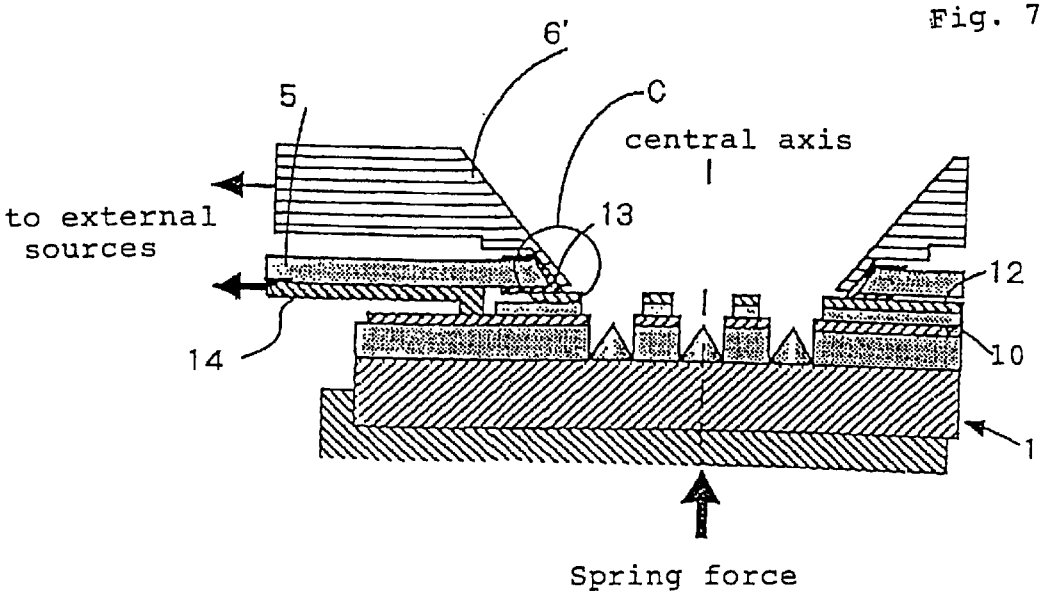
Fig. 7 ( b )
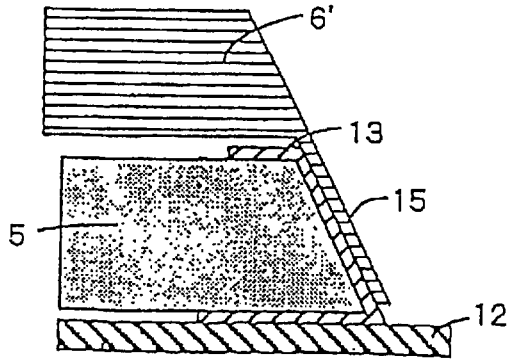

ELECTRON GUN FOR ELECTRON TUBE WITH COLD CATHODE

BACKGROUND OF THE INVENTION

1. Field of the Invention

The present invention relates to an electron gun with a cold cathode for use in a microwave electron tube such as a traveling-wave tube or the like, and more particularly to an electron gun for an electron tube with a cold cathode, which has at least two electrodes extending from a surface of the cold electrode.

2. Description of the Related Art

There has been known mounting of a cold cathode in an electron-beam device represented by a traveling-wave tube. However, no previous instance of mounting a cold cathode with a focusing electrode in such an electronbeam device as disclosed in the present invention is found in the art.

First, various conventional examples of mounting a cold cathode with no focusing electrode will be described below. Then, device mounting manners which could generally be derived from the conventional processes in order to mount a cold cathode with a focusing electrode will be described below.

1. Japanese unexamined patent publication No. 129144/97 discloses a linear beam microwave tube. As shown in FIG. 1 of the accompanying drawings, the disclosed linear beam microwave tube has cathode tip 52 with cold cathode 51 disposed on a surface thereof. Cathode tip 52 is joined by silver paste to a joint of mount support 53 which is supported by a package. Mount support 53 and cathode tip 52 are joined such that cathode tip 52 has end 55 abutting against reference surface 54 of mount support 53 and an opposite end spaced slight gap 56 from mount support 53. Cold cathode 51 can thus be accurately positioned with respect to reference surface 54. Wehnelt electrode 57 for focusing electron beam 50 emitted from cold cathode 51 is installed as follows: after Wehnelt electrode 57 has been shaped to a desired configuration, it is secured by heat-pressing to a gate electrode of cathode tip 52 so that the center of an opening of Wehnelt electrode 57 is aligned with the central axis of cold cathode 51. In operation, a predetermined potential is supplied to the gate electrode through Wehnelt electrode 57.

2. Japanese unexamined patent publication No. 115453/97 reveals an electron gun with a cold cathode. As shown in FIG. 2 of the accompanying drawings, the disclosed electron gun has first cylindrical insulator 61 and metal conductor 62 extending through a central hole in first cylindrical insulator 61 in an axial direction of the electron gun. Cold cathode 63 is mounted on emitter electrode 60 disposed on a tip end of metal conductor 62. An emitter potential of cold cathode 63 is led out of a vacuum space through metal conductor 62. First cylindrical insulator 61 and second cylindrical metal sleeve 64 disposed and abutting around first cylindrical insulator 61 are held respectively against gate electrode cylindrical metal sleeve 66 concentrically disposed around a shank of the metal conductor 62 and second cylindrical insulator 67 through conductive layer 65, abutting around gate electrode cylindrical metal sleeve 66. An end of second cylindrical metal sleeve 64 remote from conductive layer 65 is connected to a gate electrode of cold cathode 63 by metal bonding wire 68. A gate potential is thus taken out of the gate electrode through metal bonding wire 68, second cylindrical metal sleeve 64, conductive layer 65, and gate electrode cylindrical metal sleeve 66.

3. FIG. 3 of the accompanying drawings shows another conventional arrangement. As shown in FIG. 3, cold cathode emitter device 71 is fitted in a complementary recess defined in emitter electrode support 72. Cold cathode emitter device 71 is pressed against Wehnelt electrode 75 under the bias of spring 74 which acts between emitter electrode support 72 and another support 73 which is fixed in place and by which emitter electrode support 72 is supported. A gate electrode of cold cathode emitter device 71 is electrically connected to Wehnelt electrode 75.

Device mounting processes which could generally be derived from the above conventional processes in order to electrically draw out two independent electrodes, i.e., a gate electrode and a focusing electrode which are set up on a cold cathode emission surface will be described below with reference to FIGS. 4(*a*), 4(*b*), and 4(*c*) of the accompanying drawings.

The device mounting processes may include a Wehnelt electrode pressing process, a brazing process, and a resiliently biased fixing process. FIGS. 4(*a*), 4(*b*), and 4(*c*) show the resiliently biased fixing process.

For taking the potentials of two electrodes from the cold cathode emission surface, it is appropriate to take one electrode potential via the Wehnelt electrode. Specifically, as shown in FIG. 4(*a*), an electrode connected to the Wehnelt electrode is of necessity a focusing electrode due to structural limitations imposed to a cold cathode with such a focusing electrode. This is because no feeder lines can be exposed between the Wehnelt electrode and an anode disposed in facing relation to the Wehnelt electrode since an axially symmetrical electron lens should be formed between the Wehnelt electrode and the anode.

A gate electrode is usually electrically connected by a bonding wire or tab for taking an electrode potential therefrom at an outer periphery of the focusing electrode according to an electronic device mounting process.

FIG. 4(*a*) shows the use of a bonding wire for taking out a gate electrode potential, and FIG. 4(*b*) shows the use of a tab for taking out a gate electrode potential. FIG. 4(*c*) shows at enlarged scale structural details in the vicinity of a cold cathode illustrated in FIGS. 4(*a*) and 4(*b*).

For taking a potential from the gate electrode with a bonding wire, it is necessary that the bonding wire have a looped shape in order to keep its strength enough, and hence a space is required to accommodate such a looped shape. Furthermore, for maintaining a desired dielectric strength between the bonding wire and the Wehnelt electrode, the Wehnelt electrode needs to be large upwardly and diametrically, with the result that the electron gun cannot be reduced in size.

For connecting the bonding wire or tab to the cold cathode, it is necessary to exert forces to bonding wire or tag. At this time, dust particles are liable to stick between the gate electrode and the emitter electrode, developing an insulation failure therebetween which tends to cause the cold cathode to fail to operate.

Moreover, if the tab is used to connect the gate electrode, then the electron gun necessarily becomes large in outer dimensions because the electron gun needs to have a structure strong enough to withstand the driving of the tab.

SUMMARY OF THE INVENTION

It is therefore an object of the present invention to provide an electron gun for an electron tube with a cold cathode, which can be designed with increased freedom, can be reduced in size, can be assembled with ease when manufactured, has high dimensional accuracy, provides a high dielectric strength between a gate electrode and an emitter electrode, and is made highly resistant to vibrations.

An electron gun for an electron tube with a cold cathode according to the present invention has a cold cathode fixedly sandwiched between a Wehnelt electrode and an emitter electrode, and feeder path structures are connected respectively to at least two electrodes disposed on a surface of the cold cathode. Specifically, a ceramic plate is interposed between the cold cathode and the Wehnelt electrode, and at least two metallized layers associated respectively with the at least two electrodes are disposed on the ceramic plate. The metallized layers serve as the respective feeder path structures and are connected to external power supplies. The ceramic plate and the Wehnelt electrode have respective central holes aligned coaxially with the central axis of the electron gun. The central holes jointly have a tapered wall surface which spreads outwardly and through which an electron beam emitted from the cold cathode is radiated.

One of the metallized layers is continuously disposed in an entire inner wall surface of the central hole in the ceramic plate and opposite surfaces of the ceramic plate near the central hole thereof. The metallized layer is sandwiched and pressed between the Wehnelt electrode and one of the electrodes on the cold cathode. The electrode on the cold cathode is supplied with electric power via the Wehnelt electrode. Alternatively, the Wehnelt electrode has a downwardly projecting lip extending around the central hole thereof and projecting into the central hole in the ceramic plate. The downwardly projecting lip is held against the metallized layer on the inner wall surface of the central hole in the ceramic plate, and the metallized layer is pressed between the Wehnelt electrode and the electrode on the cold cathode.

The other of the metallized layers is disposed on one of the opposite surfaces of the ceramic plate which faces the cold cathode and spaced outwardly from the one of the metallized layers on the opposite surfaces of the ceramic plate near the central hole. The other of the metallized layers has an end connected to the other of the two electrodes on the surface of the cold cathode, and an opposite end connected to an external power supply. Alternatively, the ceramic plate has a hole defined therein outside of the metallized layers on the opposite surfaces of the ceramic plate near the central hole, the other of the metallized layers being continuously disposed on an entire inner wall surface of the hole in the ceramic plate and opposite surfaces of the ceramic plate near the hole. The other of the metallized layers which is disposed on one of the opposite surfaces of the ceramic plate which faces the cold cathode is connected to the other of the two electrodes on the surface of the cold cathode, and the other of the metallized layers which is disposed on the other of the opposite surfaces of the ceramic plate which faces away from the cold cathode is connected to an external power supply.

The above and other objects, features, and advantages of the present invention will become apparent from the following description when taken in conjunction with the accompanying drawings which illustrate some preferred embodiments of the present invention by way of examples.

BRIEF DESCRIPTION OF THE DRAWINGS

FIGS. 4(*a*) and 4(*b*) are cross-sectional views showing different conventional electrode connection structures;

FIG. 4(*c*) is an enlarged cross-sectional view showing structural details in the vicinity of a cold cathode illustrated in FIGS. 4(*a*) and 4(*b*);

FIG. 6(*a*) is an enlarged cross-sectional view showing electrode structural details in an encircled area A in FIG. 5 according to a first embodiment of the present invention;

FIG. 6(*b*) is an enlarged cross-sectional view showing parts in an encircled area B in FIG. 6(*a*);

FIG. 7(*a*) is an enlarged cross-sectional view showing electrode structural details according to a second embodiment of the present invention;

FIG. 7(*b*) is an enlarged cross-sectional view showing parts in an encircled area C in FIG. 7(*a*)

DETAILED DESCRIPTION OF THE PREFERRED EMBODIMENTS

Figure 1:
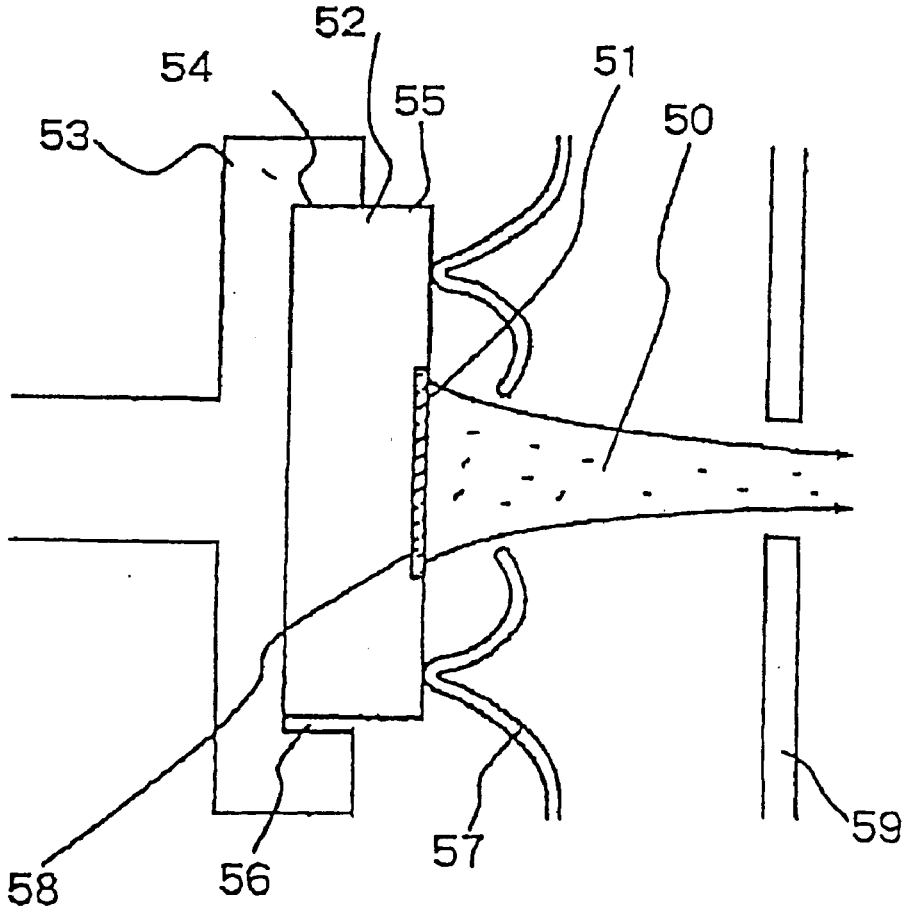
Fig. 1 (Prior Art)
FIG. 1 is a cross-sectional view of a conventional electron gun for an electron tube with a cold cathode.
Figure 2:
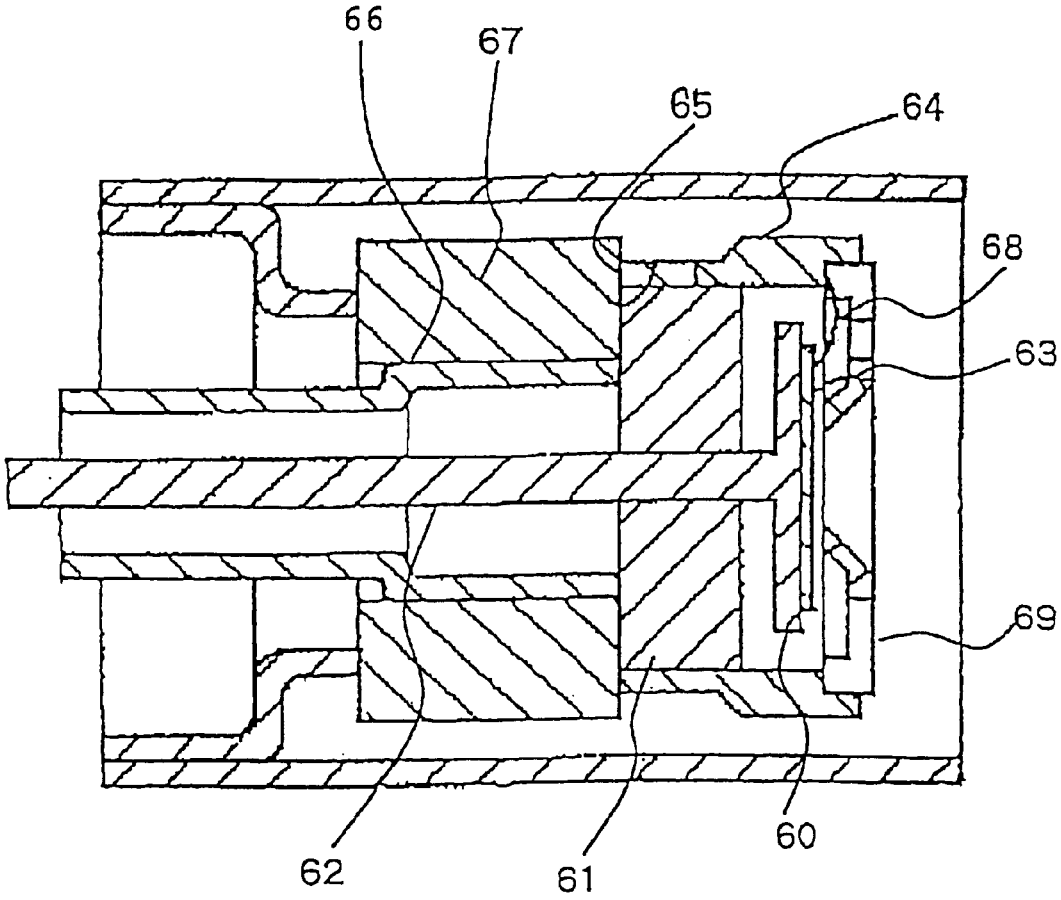
Fig. 2 (Prior Art)
FIG. 2 is a cross-sectional view of another conventional electron gun for an electron tube with a cold cathode.
Figure 3:
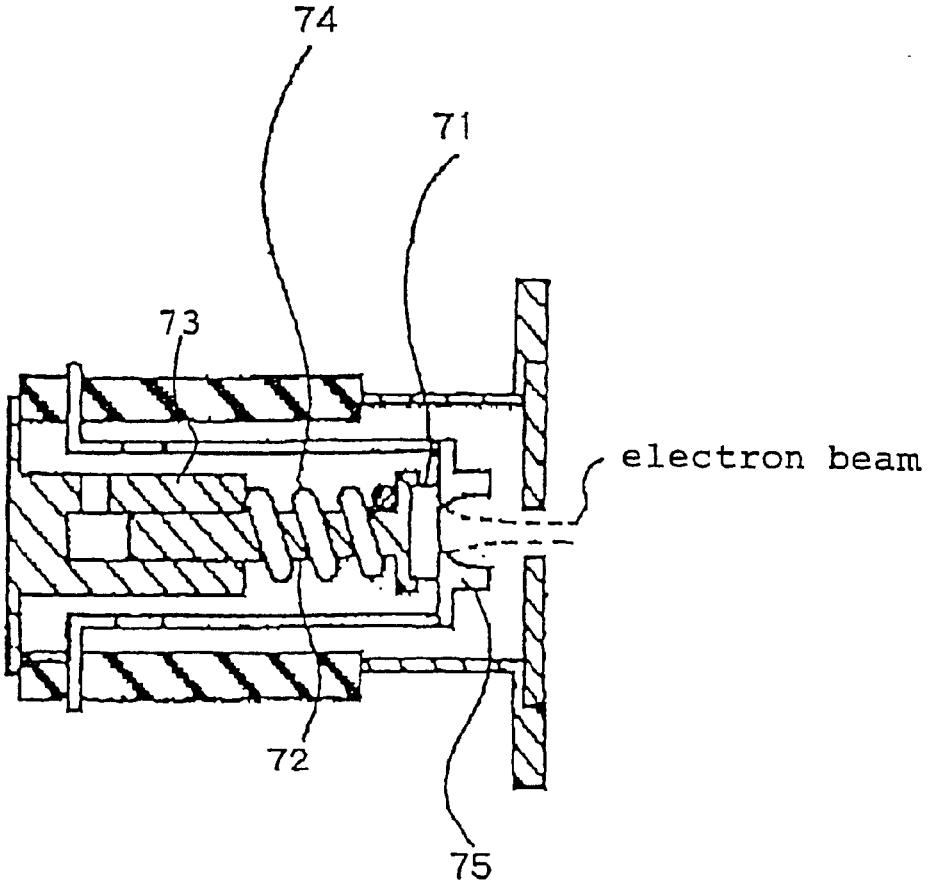
Fig. 3 (Prior Art)
FIG. 3 is a cross-sectional view of still another conventional electron gun for an electron tube with a cold cathode.
Figure 5:
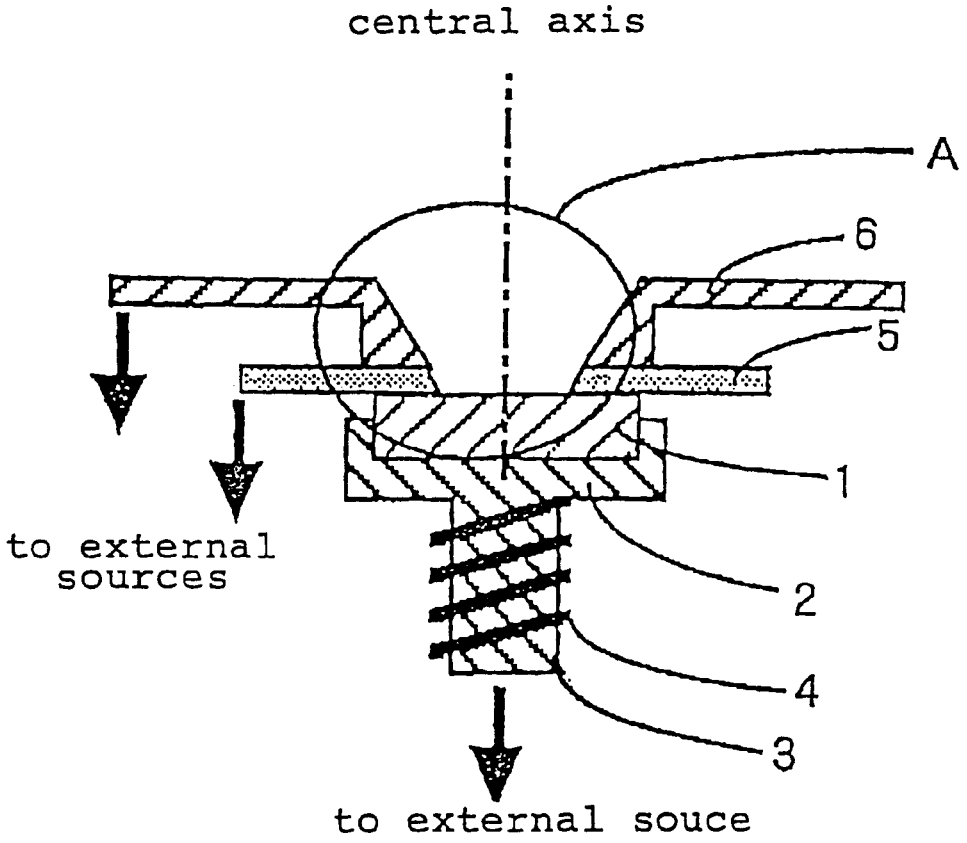
FIG. 5 is a cross-sectional view of an electron gun for an electron tube with a cold cathode according to the present invention.

As shown in FIG. 5, an electron gun for an electron tube with a cold cathode according to the present invention has cold cathode 1 disposed on emitter electrode 2 and Wehnelt electrode 6 mounted on ceramic plate 5 disposed on cold cathode 1. Cold cathode 1 is normally urged toward Wehnelt electrode 6 along the central axis of the electron gun by spring 4 disposed around support rod 3 joined to emitter electrode 2.

Wehnelt electrode 6 serves as a support structure for holding cold cathode 1, and also as an electrode for producing an electric field to focus a stream of electrons emitted from cold cathode 1 into an electron beam. When the electron gun is incorporated in a vacuum microwave device, Wehnelt electrode 6 serves as an electrode to draw out an electrode pad on a surface of the vacuum microwave element. Ceramic plate 5 is of a disk shape or polygonal shape, and has a central hole defined therein around the central axis of the electron gun for passing the electron beam emitted from cold cathode 1 therethrough. Wehnelt electrode 6 is of a ring shape surrounding the central hole in ceramic plate 5. Wehnelt electrode 6 and ceramic plate 5 have a tapered wall surface which spreads outwardly in the upward direction around the central holes in Wehnelt electrode 6 and ceramic plate 5.

FIG. 6(*a*) is an enlarged cross section showing electrode structural details in an encircled area A in FIG. 5 according to a first embodiment of the present invention.

As shown in FIG. 6(*a*), cold cathode 1 comprises conductive substrate 7 made of silicon or the like, gate electrode 10 disposed on conductive substrate 7 with insulating layer 9 interposed therebetween, and focusing electrode 12 disposed on gate electrode 10 with insulating layer 11 interposed therebetween. Cold cathode 1 of such a multilayer structure has a matrix of holes defined therein within the central hole in ceramic plate 5 and extending down to the surface of conductive substrate 7. Conical emitters 8 are positioned respectively in the holes thus defined in cold cathode 1.

When a voltage is applied between emitter electrode 2 via conductive substrate 7 and gate electrode 10, a strong electric field is produced at the tips of emitters 8 for causing emitters 8 to emit electrons. The electrons emitted by emitters 8 are focused by focusing electrode 12.

As shown in FIG. 6(*b*), ceramic plate 5 has upper and lower surfaces around the central hole thereof, and an inner wall surface of the central hole thereof, and these upper and lower surfaces of ceramic plate 5 and the inner wall surface of the central hole thereof are continuously covered with first metallized layer 13 disposed thereon. First metallized layer 13 has upper and lower surface portions held in contact with Wehnelt electrode 6 and focusing electrode 12, respectively, thus electrically connecting Wehnelt electrode 6 and focusing electrode 12 to each other. As shown in FIG. 6(*a*), second metallized layer 14 is disposed on a lower surface of ceramic plate 5 in radially outwardly spaced relation to first metallized layer 13. Second metallized layer 14 has a thicker portion positioned just outside of insulating layer 11 and connected to gate electrode 10. Focusing electrode 12 is connected to an external power supply by first metallized layer 13 and Wehnelt electrode 6, so that a focusing potential is supplied from the external power supply to all of Wehnelt electrode 6, first metallized layer 13, and focusing electrode 12. Gate electrode 10 is connected to an external power supply by second metallized layer 14, so that a gate potential is supplied from the external power supply to gate electrode 10 via second metallized layer 14.

As described above, a gate potential is applied to gate electrode 10 via second metallized layer 14 on the lower surface of ceramic plate 5, rather than a bonding wire or tab. Therefore, it is not necessary to provide a space between the Wehnelt electrode and the gate electrode for accommodating such a bonding wire or tab. As a result, the Wehnelt electrode can be designed with a greater degree of freedom. The presence of ceramic plate 5 is effective in increasing the dielectric strength between Wehnelt electrode 6 and second metallized layer 14 which serves to apply a gate potential. If the electron gun of the above construction is designed to be provided with the same dielectric strength as that of the conventional electron gun, then the electron gun may be reduced in radial size and hence reduced in overall size. Since the electrodes are not connected using bumps, no dust particles are produced when the electron gun is assembled, and hence electron guns can be assembled with an increased yield. Inasmuch as ceramic plate 5 is sandwiched between Wehnelt electrode 6 and cold cathode 1 under spring forces, the feeder path structure including second metallized layer 14 is more resistant to vibrations than the conventional bonding wire.

FIGS. 7(*a*) and 7(*b*) show in enlarged cross section electrode structural details according to a second embodiment of the present invention. As shown in FIG. 7(*b*), the second embodiment differs from the first embodiment in that Wehnelt electrode 6' has a downward lip 15 extending around the central hole thereof and projecting downwardly at the same angle as the angle of the tapered wall surface around the central hole in ceramic plate 5. Downwardly projecting lip 15 is fitted in the central hole in ceramic plate 5 and has an outer surface held in intimate contact with first metallized layer 13 on ceramic plate 5, thus bearing spring forces acting between cold cathode 1 and ceramic plate 5, and Wehnelt electrode 6'. Downwardly projecting lip 15 has an axial length which is equal to or less than the thickness of ceramic plate 5 including first metallized layer 13. Therefore, downwardly projecting lip 15 is kept out of contact with focusing electrode 12. Further a small gap is present between Wehnelt electrode 6' and the upper surface portion of first metallized layer 13 on the upper surface of ceramic plate 5 around the central hole thereof. Downwardly projecting lip 15 allows ceramic plate 5, cold cathode 1, and Wehnelt electrode 6' to be assembled in increased axial alignment with each other when cold cathode 1 is assembled in the manufacturing process of the electron gun. If the tip of downwardly projecting lip 15 is sufficiently close to focusing electrode 12, then the electron gun can be designed while ignoring variations in the inside diameter of the central hole in ceramic plate 5, and hence can be manufactured with increased accuracy.

Figure 8:
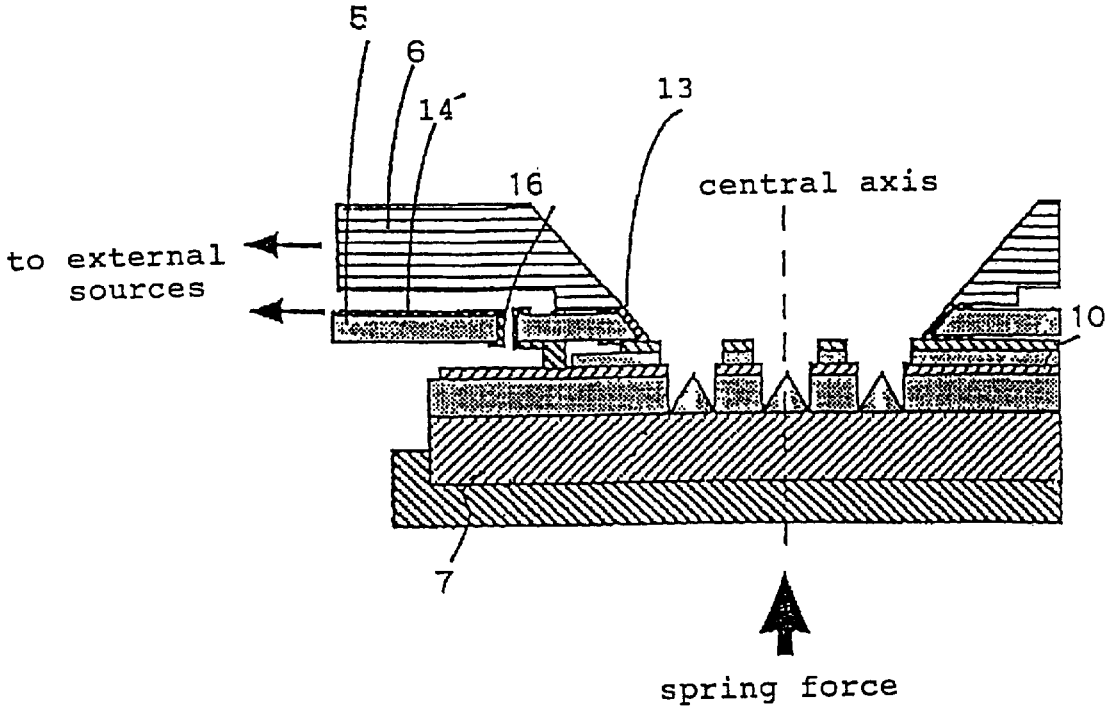
FIG. 8 is an enlarged cross-sectional view showing electrode structural details according to a third embodiment of the present invention.

FIG. 8 shows in enlarged cross section electrode structural details according to a third embodiment of the present invention. The third embodiment differs from the first and second embodiments in that ceramic plate 5 has through hole 16 defined therein and second metallized layer 14' is disposed on an inner wall surface of through hole 16 and upper and lower surfaces of ceramic plate 5. No second metallized layer is present on the lower surface of ceramic plate 5 radially outwardly of the through hole 16. Gate electrode 10 is connected to an external power supply by second metallized layer 14' on the inner wall surface of through hole 16 and upper surface of ceramic plate 5. This structure is effective in increasing electric insulation between conductive substrate 7 and second metallized layer 14' on ceramic plate 5. Specifically, even when conductive foreign matter is caught between ceramic plate 5 and conductive substrate 7, a short circuit is prevented from occurring between second metallized layer 14' and conductive substrate 7.

As described above, according to the present invention, the cold cathode and the Wehnelt electrode are pressed against each other with the ceramic plate interposed therebetween, and the metallized layer for supplying a potential from the external power supply to the gate electrode is disposed on the ceramic plate. Dielectric strength is improved between the conductive substrate and the feeder path structure by which a potential is supplied to the gate electrode. The Wehnelt electrode can be desired with increased degree of freedom, allowing the electron gun to be reduced in size. Various parts can easily be axially aligned and assembled, and electron guns can be manufactured with an increased yield. The electron gun according to the present invention is highly resistant to vibrations.

Although certain preferred embodiments of the present invention have been shown and described in detail, it should be understood that various changes and modifications may be made therein without departing from the scope of the appended claims.

What is claimed is:

1. An electron gun for an electron tube with a cold cathode, comprising:

an emitter electrode;

a Wehnelt electrode;

a cold cathode fixedly sandwiched between said emitter electrode and said Wehnelt electrode;

at least two electrodes disposed on a surface of said cold cathode;

feeder path structures connected respectively to said two electrodes; and a ceramic plate disposed between said cold cathode and said Wehnelt electrode, said ceramic plate having on a portion of surface thereof at least two metallized layers serving as said feeder path structures, respectively.

2. An electron gun according to claim 1, wherein said ceramic plate is of a disk shape.

3. An electron gun according to claim 1, wherein said ceramic plate is of a polygonal shape.

4. An electron gun according to claim 2, wherein said ceramic plate has a central hole defined therein and having a central axis aligned with the central axis of the electron gun, said central hole having a tapered wall surface which spreads outwardly away from said cold cathode.

5. An electron gun according to claim 4, wherein said Wehnelt electrode has a hole defined therein ant having a central axis aligned with the central axis of the electron gun, said hole having an inside diameter greater than the inside diameter of said central hole in the ceramic plate.

6. An electron gun according to claim 5, wherein one of said metallized layers is continuously disposed on an entire inner wall surface of said central hole in said ceramic plate and opposite surface of said ceramic plate near said central hole.

7. An electron gun according to claim 6, wherein one of said two electrodes on the surface of said cold cathode and said Wehnelt electrode are pressed against each other with one of said metallized layers on the opposite surfaces of said ceramic plate being interposed therebetween.

8. An electron gun according to claim 7, wherein the other of said metallized layers is disposed on one of said opposite surfaces of said ceramic plate which faces said cold cathode and spaced outwardly from said one of the matallized layers on said opposite surfaces of said ceramic plate near said central hole, said other of said metallized layers being connected to the other of said two electrodes on the surface of said cold cathode.

9. An electron gun according to claim 7, wherein said ceramic plate has a hole defined therein outside of the metallized layers on said opposite surfaces of said ceramic plate near said central hole, the other of said metallized layers being continuously disposed on an entire inner wall surface of said hole in said ceramic plate and opposite surfaces of said ceramic plate near said hole, and wherein the other of said metallized layers which is disposed on one of said opposite surfaces of said ceramic plate which faces said cold cathode is connected to the other of the said two electrodes on the surface of said cold cathode, and the other of said metallized layers which is disposed on the other of said opposite surfaces of said ceramic plate which faces away from said cold cathode is connected to an external power supply.

10. An electron gun according to claim 6, wherein said Wehnelt electrode has a projecting lip extending around the hole thereof and fitted against the metallized layer on the inner wall surface of said central hole in said ceramic plate, said projecting lip being shorter than the thickness of said ceramic plate.

11. An electron gun according to claim 10, wherein one of said two electrodes on the surface of said cold cathode and said Wehnelt electrode are pressed against each other with one of said metalized layers on the inner wall surface of said central hole in said ceramic plate and said projecting lip being interposed therebetween.

12. An electron gun according to claim 11, wherein the other of said metallized layers is disposed on one of said opposite surfaces of said ceramic plate which faces said cold cathode and spaced outwardly from said one of the matallized layers on said opposite surfaces of said ceramic plate near said central hole, said other of said metallized layers being connected to the other of said two electrodes on the surface of said cold cathode.

13. An electron gun according to claim 12, wherein said ceramic plate has a hole defined therein outside of the metallized layers on said opposite surfaces of said ceramic plate near said central hole, the other of said metallized layers being continuously disposed on an entire inner wall surface of said hole in said ceramic plate and opposite surfaces of said ceramic plate near said hole, and wherein the other of said metallized layers which is disposed on one of said opposite surfaces of said ceramic plate which faces said cold cathode is connected to the other of the said two electrodes on the surface of said cold cathode, and the other of said metallized layers which is disposed on the other of said opposite surfaces of said ceramic plate which faces away from said cold cathode is connected to an external power supply.

14. An electron gun according to claim 3, wherein said ceramic plate has a central hole defined therein and having a central axis aligned with the central axis of the electron gun, said central hole having a tapered wall surface which spreads outwardly away from said cold cathode.

15. An electron gun according to claim 14, wherein said Wehnelt electrode has a hole defined therein and having a central axis aligned with the central axis of the electron gun, said hole having an inside diameter greater than the inside diameter of said central hole in the ceramic plate.

16. An electron gun according to claim 15, wherein one of said metallized layers is continuously disposed on an entire inner wall surface of said central hole in said ceramic plate and opposite surface of said ceramic plate near said central hole.

17. An electron gun according to claim 16, wherein one of said two electrodes on the surface of said cold cathode and said Wehnelt electrode are pressed against each other with one of said metallized layers on the opposite surfaces of said ceramic plate being interposed therebetween.

18. An electron gun according to claim 17, wherein the other of said metallized layers is disposed on one of said opposite surfaces of said ceramic plate which faces said cold cathode and spaced outwardly from said one of the matallized layers on said opposite surfaces of said ceramic plate near said central hole, said other of said metallized layers being connected to the other of said two electrodes on the surface of said cold cathode.

19. An electron gun according to claim 17, wherein said ceramic plate has a hole defined therein outside of the metallized layers on said opposite surfaces of said ceramic plate near said central hole, the other of said metallized layers being continuously disposed on an entire inner wall surface of said hole in said ceramic plate and opposite surfaces of said ceramic plate near said hole, and wherein the other of said metallized layers which is disposed on one of said opposite surfaces of said ceramic plate which faces said cold cathode is connected to the other of the said two electrodes on the surface of said cold cathode, and the other of said metallized layers which is disposed on the other of said opposite surfaces of said ceramic plate which faces away from said cold cathode is connected to an external power supply.

20. An electron gun according to claim 16, wherein said Wehnelt electrode has a projecting lip extending around the hole thereof and fitted against the metallized layer on the inner wall surface of said central hole in said ceramic plate, said projecting lip being shorter than the thickness of said ceramic plate.

21. An electron gun according to claim 20, wherein one of said two electrodes on the surface of said cold cathode and said Wehnelt electrode are pressed against each other with one of said metallized layers on the inner wall surface of said central hole in said ceramic plate and said projecting lip being interposed therebetween.

22. An electron gun according to claim 21, wherein the other of said metallized layers is disposed on one of said opposite surfaces of said ceramic plate which faces said cold cathode and spaced outwardly from said one of the matallized layers on said opposite surfaces of said ceramic plate near said central hole, said other of said metallized layers being connected to the other of said two electrodes on the surface of said cold cathode.

23. An electron gun according to claim 22, wherein said ceramic plate has a hole defined therein outside of the metallized layers on said opposite surfaces of said ceramic plate near said central hole, the other of said metallized layers being continuously disposed on an entire inner wall surface of said hole in said ceramic plate and opposite surfaces of said ceramic plate near said hole, and wherein the other of said metallized layers which is disposed on one of said opposite surfaces of said ceramic plate which faces said cold cathode is connected to the other of the said two electrodes on the surface of said cold cathode, and the other of said metallized layers which is disposed on the other of said opposite surfaces of said ceramic plate which faces away from said cold cathode is connected to an external power supply.

* * * * *